US005521757A

United States Patent [19]

Olson

[11] Patent Number: 5,521,757

[45] Date of Patent: May 28, 1996

[54] ADJUSTMENT LEVER FOR ATTACHMENT TO A SCOPE ADJUSTMENT RING

[76] Inventor: Kevin Olson, Rte. 4, Box 228, Alexandria, Minn. 56308

[21] Appl. No.: 37,575

[22] Filed: Mar. 26, 1993

Related U.S. Application Data

[63] Continuation-in-part of Ser. No. 753,673, Sep. 3, 1991, Pat. No. Des. 342,537.

[51] Int. Cl.[6] ..... G02B 23/00; F41G 1/38

[52] U.S. Cl. ..... 359/425; 359/399; 359/422; 42/101; 33/246

[58] Field of Search ..... 359/425–429, 359/823, 826, 819, 694–700; 356/150, 151, 153, 250, 251, 252; 33/245, 246, 251, 248; 42/100, 101; D16/132, 136; D22/109, 110

[56] References Cited

U.S. PATENT DOCUMENTS

| | | | |
|---|---|---|---|
| D. 248,309 | 6/1978 | Weast | D22/110 |
| 465,088 | 12/1891 | Patchen | 359/428 |
| 2,355,384 | 8/1944 | Litschert | 33/246 |
| 2,454,686 | 11/1948 | Back | 359/432 |
| 2,913,826 | 11/1959 | Petty | 33/246 |
| 3,418,032 | 12/1968 | Kajiro | 359/418 |
| 3,492,733 | 2/1970 | Leatherwood | 359/428 |
| 3,506,330 | 4/1970 | Allen | 356/397 |
| 3,782,822 | 1/1974 | Spence | 359/428 |
| 4,094,587 | 6/1978 | Besenmatter et al. | 359/673 |
| 4,341,022 | 7/1982 | Santoro | 33/245 |
| 4,472,033 | 9/1984 | Fukuhara et al. | 359/698 |
| 4,574,508 | 3/1986 | Ross | 42/101 |
| 4,618,221 | 10/1986 | Thomas | 359/428 |
| 4,626,077 | 12/1986 | Yamamoto | 359/696 |
| 4,749,268 | 6/1988 | Moskovich et al. | 359/698 |
| 4,802,717 | 2/1989 | Kebo | 359/354 |
| 4,841,659 | 6/1989 | Williams | 42/101 |
| 4,844,586 | 7/1989 | Suzuki et al. | 359/824 |
| 4,899,450 | 2/1990 | Huggins | 33/245 |
| 4,926,576 | 5/1990 | Maes et al. | 42/101 |
| 4,952,041 | 8/1990 | Sandall | 359/428 |
| 5,026,158 | 6/1991 | Golubic | 356/252 |
| 5,180,875 | 1/1993 | Berry, Jr. et al. | 33/245 |
| 5,276,554 | 1/1994 | Nassivera | 359/694 |

FOREIGN PATENT DOCUMENTS

| | | | |
|---|---|---|---|
| 3399 | of 1862 | United Kingdom | 33/246 |

*Primary Examiner*—Thong Q. Nguyen
*Attorney, Agent, or Firm*—Peterson, Wicks, Nemer & Kamrath

[57] ABSTRACT

An apparatus (10) for removable attachment to the adjustment ring (26) of telescope sights (12) for firearms (14) or the like is disclosed including a pinch clamping band (28) having an integral, elongated linear projection (42) extending axially therefrom. The clamping band (28) includes a split, annular wall (30) having a transverse radial cut defining first and second, free ends (32, 34). The free ends (32, 34) of the annular wall (30) are drawn together by a bolt (40) extending between bosses (36, 38) extending outwardly from the annular wall (30) on opposite sides of the transverse cut. A lever (50) has a securement end (52) positionable between the free ends (32, 34) of the annular wall (30) and including an aperture (60) for slideably receiving the bolt (40). The lever (50) extends axially from the clamping band (28) parallel to the axis (A) of the adjustment ring (26) and the projection (42). C-shaped adapters (46) having an internal surface for slideable receipt on the adjustment ring (26) and having an external surface for slideably receiving the annular wall (30) can be provided to allow the annular wall (30) to fit different sizes of adjustment rings (26). The adjustment ring (26) can be rotated by pushing the free ends of the lever (50) and/or the projection (42) at a location axially spaced from the adjustment ring (26) and adjacent to the ocular end of the eyepiece (22) to allow the hands of the shooter to be in an aiming and firing condition on the firearm (14) while adjusting the magnification of the telescope sight (12).

26 Claims, 1 Drawing Sheet

ADJUSTMENT LEVER FOR ATTACHMENT TO A SCOPE ADJUSTMENT RING

CROSS REFERENCE

The present application is a continuation-in-part of application Ser. No. 07/753,673 filed Sep. 3, 1991, now U.S. Pat. No. Des. 342,537.

BACKGROUND

The present invention generally relates to variable power telescope sights for firearms or the like, particularly to after-market attachments to such variable power telescope sights and specifically to apparatus for attachment to the adjustment ring of such variable power telescope sights.

Many telescope sights have adjustable magnification from 3x to 9x, for example, to allow targets to be magnified according to the distance of the hunter to the target. Adjustment of the telescope sight is accomplished by turning an adjustment ring adjacent the ocular end of the sight. Prior to the present invention, adjustment was typically accomplished by pinching the ring between two fingers, such as the thumb and forefinger, and rotating the ring thereby. It can then be appreciated, for example, that if it was desired to adjust the magnification of the scope while aiming (for example, when a target comes into view), it was necessary to release one hand (typically the hand including the trigger finger) from the rifle (or other firearm), rotate the adjustment ring with the free hand, and after adjustment place the hand back in firing position on the rifle. This is relatively time consuming and does not allow the rifle to be quickly fired after adjustment. It can also be appreciated that the target is often moving so that the magnification desired may change with movement of the target.

Thus, a need exists for a method which allows adjustment of the scope adjustment ring while the hand remains on the firearm or the like and particularly while the finger of the hand remains adjacent to the trigger of the firearm for actuation thereof. Additionally, a need exists for an attachment to existing scope adjustment rings to carry out such method which can be added to existing variable power telescope sights without modification allowing removal from the variable power telescope sights when use thereof is not needed or desired.

SUMMARY

The present invention solves these needs and other problems in the field of variable power telescope sights by providing, in the preferred form, a member for securement, and in the most preferred form, for removable securement to the magnification adjustment ring in a fixed, non-movable relation and including a projection extending therefrom having a free end adjacent to the ocular end of the sight eyepiece, with the free end being pushable to place a circumferential force thereon axially spaced from the magnification adjustment ring and adjacent to the ocular end of the sight eyepiece to rotate the projection, the securement member, and the magnification adjustment ring about the axis of the magnification adjustment ring.

In one aspect of the present invention with the securement member comprising a pinch clamping band, a lever is removably received between the free ends of the clamping band and extends axially from the securement end. In a most preferred form, a projection integrally extends from the clamping band diametrically opposite to the lever and has an axial length substantially longer than the axial length of the lever from the clamping band.

In another aspect of the present invention with the securement member being removably secured to the adjustment ring, a C-shaped adapter is provided having an internal surface for slideable receipt on the magnification adjustment ring and an external surface for slideably receiving the securement member.

It is thus an object of the present invention to provide a novel apparatus for attachment to the magnification adjustment ring of telescope sights.

It is further an object of the present invention to provide such a novel apparatus for removable attachment to the magnification adjustment ring.

It is further an object of the present invention to provide such a novel apparatus allowing adjustment of the magnification while holding the firearm in an aiming and firing condition.

It is further an object of the present invention to provide such a novel apparatus allowing faster shooting of the firearm.

It is further an object of the present invention to provide such a novel apparatus which is easy to install on existing telescope sights without modification thereof.

It is further an object of the present invention to provide such a novel apparatus which can be removed without detrimental consequences to the continued use and appearance of the telescope sight.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2:
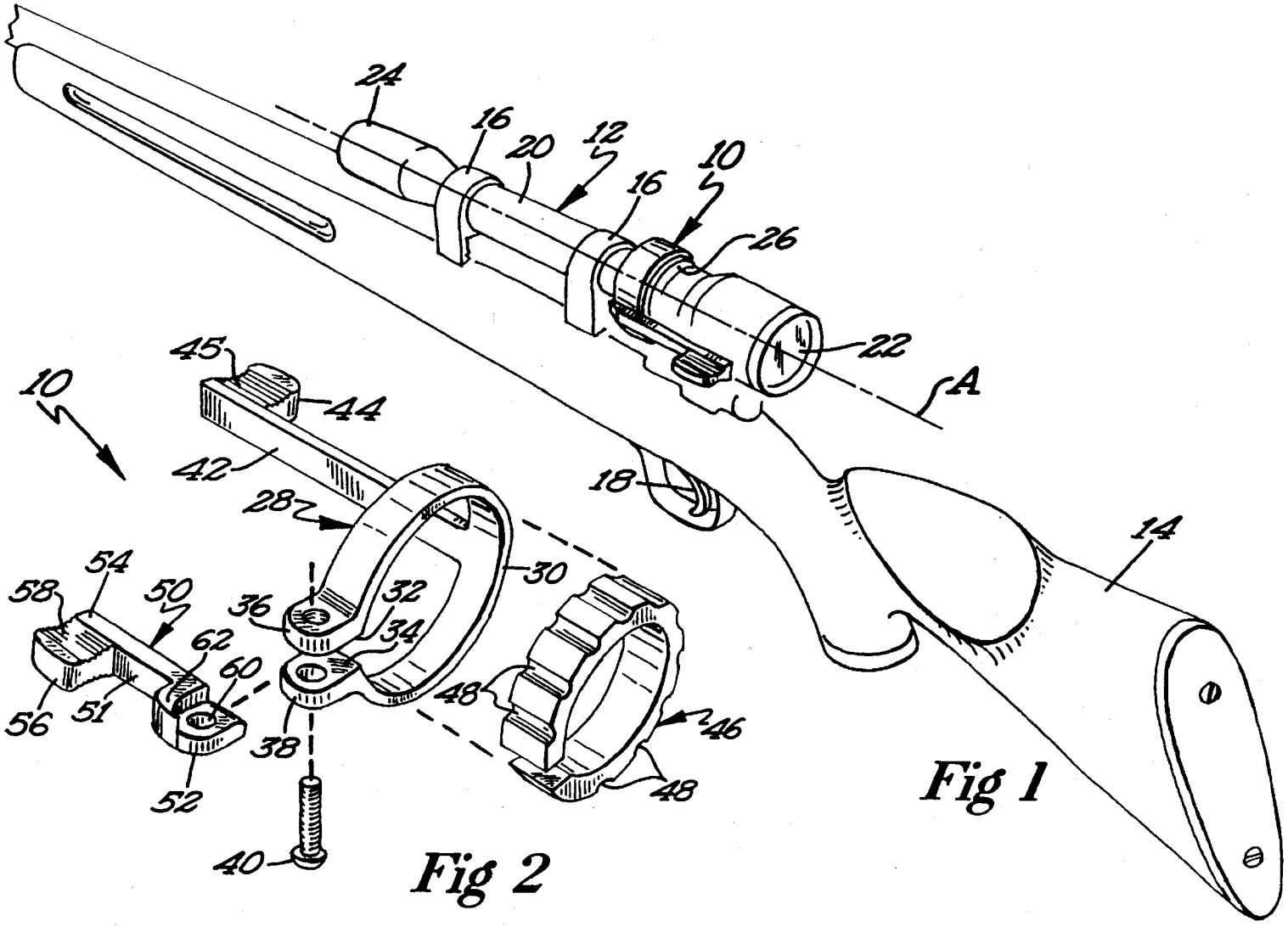
FIG. 1 shows a perspective view of a firearm including an apparatus for removable attachment to the magnification adjustment ring of a variable power telescope sight according to the preferred teachings of the present invention.
FIG. 2 shows an exploded, perspective view of the apparatus of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "length", "end", "side", "axial", "circumferential", "radial", "center", and similar terms are used herein, it should be understood that these terms have reference only to the structure shown in the drawings as it would appear to a person viewing the drawings and are utilized only to facilitate describing the invention.

DESCRIPTION

An adjustment apparatus for removable attachment to an adjustment ring of variable power telescope sights for firearms or the like according to the preferred teachings of the present invention is shown in the drawings and generally designated 10. Telescope sight 12 is typically mounted to a firearm 14 via suitable clamps 16 for aiming the bullet or similar missle trajectory of firearm 14. Firearm 14 includes a trigger 18 which is actuated by pulling for firing the bullet or similar missle. Generally, telescope sight 12 includes a barrel 20, an eyepiece 22, an objective 24, and an adjustment ring 26 axially spaced from the ocular end of eyepiece 22. Rotation of adjustment ring 26 about its axis (A) actuates a zoom element within telescope sight 12 so that the target image can be made to look larger or smaller in proportion to the field. The target aim point appears to move downwardly with increasing magnification allowing magnification increases as range increases, as is desirable for precision of aim.

Adjustment apparatus 10 generally includes a member 28 for removable securement to adjustment ring 26 of telescope sight 12 in a fixed, non-movable relation thereto. In the most preferred form, member 28 is a pinch clamping band and generally includes an annular wall 30 of a shape generally corresponding to that of adjustment ring 26. Wall 30 is split and includes a transverse radial cut defining first and second free ends 32 and 34 in wall 30. First and second, spaced, parallel bosses 36 and 38 are provided on wall 30 on opposite sides of the transverse cut and extending outwardly from wall 30 parallel to and on opposite sides of a diameter of wall 30 upon which the transverse radial cut lies. For drawing ends 32 and 34 together and clamping wall 30 upon adjustment ring 26, a bolt 40 is provided extending through an aperture in one of bosses 36 and 38 and threadably received in the other of bosses 36 and 38.

Adjustment apparatus 10 further includes a projection 42 extending axially from wall 30 at a point diametrically opposite to the transverse radial cut, ends 32 and 34, and bosses 36 and 38 and extending generally parallel to and spaced from the center axis of the annular shape of annular wall 30 and the axis (A) of adjustment ring 26. In the most preferred form, projection 42 has an elongated, linear configuration and a length generally equal to but slightly less than the axial distance between the ocular end of eyepiece 22 and adjustment ring 26 of telescope sight 12 such that the free end of projection 42 is adjacent to the ocular end of the eyepiece 22.

Adjustment apparatus 10 further includes a tab 44 extending radially from the free end of projection 42 opposite to wall 30. Particularly, tab 44 extends from projection 42 radially outwardly from the annular shape of wall 30 and particularly in a direction opposite to bosses 36 and 38. In the most preferred form, tab 44 includes knurling 45 on opposite sides thereof and extending between the opposite axial ends of tab 44 generally parallel to and spaced from the center axis of the annular shape of annular wall 30 and from projection 42. In the most preferred form, band 28, projection 42, and tab 44 are of an integral one-piece design constructed of high-grade aluminum anodized in dull black for non-glare or shine.

It can be appreciated that adjustment rings 26 are of different sizes and diameters depending upon the particular type and manufacturer of telescope sight 12 on which apparatus 10 is utilized. In this regard, member 28 could be manufactured in various sizes to fit adjustment rings 26 of the various types and manufacture of telescope sights 12 available. However, in the most preferred form, apparatus 10 further includes a C-shaped adapter 46 having an internal surface for slideable receipt on adjustment ring 26 and an external surface for slideably receiving annular wall 30. It can then be appreciated that adapters 46 can be formed of plastic and of a plurality of different thicknesses to correspond to and fit adjustment rings 26 of the various types and manufacture of telescope sights 12. In this regard, apparatus 10 can be marketed with an adapter 46 as an accessory which can be separately purchased for the particular telescope sight 12 or with a plurality of adapters 46 including a range of thicknesses, with adapter 46 corresponding to the particular telescope sight 12 being selected and the remaining adapters 46 being stored or discarded. To reduce the amount of material utilized and to increase flexibility especially in adapters 46 of a substantial thickness, axially extending, parallel, circumferentially spaced, flex notches 48 may be formed in the external surface of adapter 46. Additionally, adapters 46 can also be made of minimal thickness having a major purpose of protecting paint or other surface finish including knurling on adjustment ring 26 of telescope sight 12.

In a preferred form of the present invention, apparatus 10 includes a lever 50 having a projection 51 of an elongated, linear configuration and including a securement end 52 and a free end 54. Lever 50 includes a tab 56 extending radially from free end 54 of projection 51 and having knurling 58 on opposite sides thereof and extending between the opposite axial ends of tab 56 generally parallel to and spaced from the elongated dimension of projection 51. An aperture 60 is formed in securement end 52 of a size for slideably receiving bolt 40. Securement end 52 further includes a mast 62 having a shape complementary to and for abutting with an axial end of boss 36 to prevent pivoting of lever 50 about bolt 40 with free end 54 moving radially inward of securement end 52, with tab 56 extending from free end 54 radially outwardly from the center axis of wall 30 and of the rotation axis (A) of adjustment ring 26. In the most preferred form, lever 50 is formed of the same material as band 28, projection 42, and tab 44.

Now that the basic construction of apparatus 10 according to the preferred teachings of the present invention has been disclosed, the installation, operation, and subtle features of apparatus 10 can be set forth and appreciated. Particularly, adjustment ring 26 is rotated clockwise to its rotational stop for right-handed shooters (counter-clockwise for left-handed shooters). Adapter 46, if desired or necessary, of the proper size can then be slid upon adjustment ring 26. Band 28 can then be axially slid on telescope sight 12 and onto adjustment ring 26 and/or adapter 46 or alternately, ends 32 and 34 can be separated to allow placement of band 28 on adjustment ring 26 and/or adapter 46. Band 28 and adapter 46 can then be rotated relative to adjustment ring 26 until free ends 32 and 34 of wall 30 are located at the three o'clock position on adjustment ring 26. Bolt 40 can then be inserted and tightened in bosses 36 and 38 for drawing bosses 36 and 38 and ends 32 and 34 together to clamp and secure wall 30 upon adapter 46 and/or adjustment ring 26, with band 28 being in a fixed, non-movable relation thereto. When installed on telescope sight 12, projection 42 extends generally axially from band 28 spaced from and parallel to the axis (A) of adjustment ring 26 with the free end of projection 42 and tab 44 adjacent to the ocular end of eyepiece 22 and in the most preferred form recessed therefrom and particularly within the axial extent of telescope sight 12 to avoid accidental eye contact with apparatus 10.

In use in the field, apparatus 10 according to the teachings of the present invention allows the shooter's hands to be free for aiming and shooting of firearm 14 while allowing the adjustment of magnification of telescope sight 12. Particularly, for a right-handed shooter, firearm 14 is aimed by placing the left hand to support the stock adjacent the free end of the barrel and placing the right hand witch the index finger or forefinger on trigger 18. With the hands in this position, the thumb can be utilized to push the free end of projection 42 and tab 44 located at a position axially spaced from adjustment ring 26 and adjacent to the ocular end of eyepiece 22 to rotate projection 42 and tab 44 about the axis (A) of adjustment ring 26 and to thereby rotate adjustment ring 26 to adjust the magnification of telescope sight 12 while the index finger remains on trigger 18 and firearm 14 is held in an aiming and firing condition. Particularly, neither hand is required to be removed from firearm 14 to pinch adjustment ring 26 between two, fingers and rotate adjustment ring 26 as was performed prior to the present invention, with the removal of either hand typically not allowing firearm 14 to be fired. With apparatus 10 of the present invention, firearm 14 can remove 4 to 5 seconds off the time required for firing when the hand was removed from firearm 14 to adjust ring 26, which can be the difference between getting off the shot or not. Additionally, as the target is often moving so that adjustment of magnification may be continuously desired, apparatus 10 according to the teachings of the present invention allows more accurate aiming of firearm 14 especially when time is a factor to insure the successful harvest of the target while reducing wounding the target allowing its escape.

Adjustment rings 26 in some telescope sights 12 are relatively very difficult to rotate (and often include a handle to facilitate adjustment). In the preferred form of apparatus 10 according to the preferred teachings of the present invention and especially for telescope sights 12 having difficult to rotate adjustment rings 26, lever 50 can be secured to adjustment ring 26 in addition to projection 42. Particularly, prior to the insertion of bolt 40 into bosses 36 and 38, securement end 52 of lever 50 can be inserted between bosses 36 and 38 with mast 62 abutting with the axial end of boss 36. Bolt 40 is then inserted into bosses 36 and 38 and aperture 60 and tightened in bosses 36 and 38, with securement end 52 being sandwiched and/or positioned between bosses 36 and 38. It can then be appreciated that lever 50 extends generally axially from band 28 spaced from and parallel to the axis (A) of adjustment ring 26 and to projection 42, and in the most preferred form on diametrically opposite sides of telescope sight 12. In the preferred form, the axial length of the free end of projection 42 and tab 44 from band 28 and adjustment ring 26 is substantially longer than the axial length of free end 54 and tab 56 from band 28 and adjustment ring 26, and in the most preferred form is double the axial length of free end 54 and tab 56 from band 28 and adjustment ring 26. Tab 56 extends from free end 54 radially outward from the axis (A) of adjustment ring 26. The abutment of mast 62 with boss 36 prevents lever 50 from pivoting about bolt 40 at least to prevent free end 54 of lever 50 from moving radially inward relative to securement end 52. Free end 54 and tab 56 can then be pushed by another of the fingers on the hand with the finger on trigger 18 simultaneously as the free end of projection 42 and tab 44 are being pushed by the thumb of the same hand. It can then be appreciated that adjustment of ring 26 can be accomplished with firearm 14 held in its aiming and firing condition, even when a single finger adjustment may be insufficient for hard to rotate adjustment rings 26. It should be appreciated that tabs 44 and 56 extend radially outward from the axis (A) of adjustment ring 26 and increase the pushing area of the free end of projection 42 and of free end 54 of lever 50, respectively, with knurling 45 and 58 preventing the finger from slipping from tabs 44 and 56 when placing circumferential force thereon in either direction.

It should then be noted that apparatus 10 according to the teachings of the present invention is easy to install on existing telescope sights 12 without requiring drilling and/or tapping of adjustment ring 26 or other modification to telescope sight 12. In this regard, apparatus 10 can be located to straddle or otherwise position itself on adjustment ring 26 relative to any factory installed handle utilized to facilitate adjustment of hard to adjust rings 26. Thus, apparatus 10 can be removed from telescope sight 12 if and when desired without any detrimental consequences to the continued use and appearance of telescope sight 12, with adapters 46 providing additional scratch protection to adjustment ring 26.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. For use with a variable power telescope sight having an eyepiece including an ocular end and a magnification adjustment ring axially spaced from the ocular end of the eyepiece, with the magnification adjustment ring being rotatable about an axis, an apparatus for rotating the magnification adjustment ring by a circumferential force axially spaced from the magnification adjustment ring and adjacent to the ocular end of the eyepiece comprising, in combination: a projection having an elongated, linear configuration and a free end; and means for securing the projection to the magnification adjustment ring in a fixed, non-movable relation thereto, with the projection extending generally axially from the securing means spaced from and parallel to the axis of the magnification adjustment ring with the free end of the projection being adjacent to the ocular end of the eyepiece and pushable to rotate the magnification adjustment ring about the axis.

2. The apparatus of claim 1 further comprising, in combination: a tab extending from the free end of the projection and radially outwardly from the axis of the magnification adjustment ring for creating an increased pushing area for the free end of the projection.

3. The apparatus of claim 2 wherein the tab includes opposite axial ends, with the tab further including knurling on opposite sides thereof, with the knurling extending between the opposite axial ends of the tab generally parallel to and spaced from the axis of the magnification adjustment ring.

4. The apparatus of claim 1 wherein the securing means comprises means for removably securing the projection to the magnification adjustment ring in the fixed, non-movable relation.

5. The apparatus of claim 4 wherein the magnification adjustment ring has a shape; and wherein the securing means comprises a pinch clamping band including an annular wall of a shape generally corresponding to the shape of the magnification adjustment ring, with the annular wall including a transverse cut defining first and second free ends, and including means for drawing the first and second free ends of the annular wall together to clamp the annular wall upon the magnification adjustment ring.

6. The apparatus of claim 5 wherein the drawing means comprises, in combination: first and second, parallel bosses on the annular wall on opposite sides of the transverse cut and extending outwardly from the annular wall; and a bolt extending between the first and second bosses for drawing the first and second bosses together.

7. The apparatus of claim 6 wherein the transverse cut lies along a diameter of the annular wall; and wherein the bosses are parallel to and on opposite sides of the transverse cut.

8. The apparatus of claim 7 wherein the projection integrally extends from the wall diametrically opposite the transverse cut.

9. The apparatus of claim 8 further comprising, in combination: a lever removably received between the first and second free ends of the annular wall and having a free end, with the free end of the lever being pushable to rotate the magnification adjustment ring about the axis.

10. The apparatus of claim 9 wherein the free end of the lever has an axial length from the securing means; and wherein the free end of the projection has an axial length from the securing means which is substantially longer than the axial length of the free end of the lever from the securing means.

11. The apparatus of claim 9 wherein the lever has a securement end opposite to the free end, with the securement end including an aperture positioned between the first and second bosses, with the bolt extending through the aperture of the securement end of the lever, with the securement end including a mast for abutting with one of the first and second bosses to prevent pivoting of the lever about the bolt with the free end of the lever moving radially inward relative to the securement end.

12. The apparatus of claim 9 wherein the lever has an elongated, linear configuration, with the lever extending generally axially from the securing means spaced from and parallel to the axis of the magnification adjustment ring and the projection.

13. For use with a variable power telescope sight having an eyepiece including an ocular end and a magnification adjustment ring axially spaced from the ocular end of the eyepiece, with the magnification adjustment ring being rotatable about an axis, an apparatus for rotating the magnification adjustment ring by a circumferential force axially spaced from the magnification adjustment ring and adjacent to the ocular end of the eyepiece comprising, in combination: a projection having a free end; and means for removably securing the projection to the magnification adjustment ring in a fixed, non-movable relation thereto, with the free end being adjacent to the ocular end of the eyepiece, with the free end of the projection being pushable to rotate the magnification adjustment ring about the axis.

14. The apparatus of claim 13 wherein the magnification adjustment ring has a shape; and wherein the securing means comprises a pinch clamping band including an annular wall of a shape generally corresponding to the shape of the magnification adjustment ring, with the annular wall including a transverse cut defining first and second free ends, and including means for drawing the first and second free ends of the annular wall together to clamp the annular wall upon the magnification adjustment ring.

15. The apparatus of claim 14 wherein the drawing means comprises, in combination: first and second, parallel bosses on the annular wall on opposite sides of the transverse cut and extending outwardly from the annular wall; and a bolt extending between the first and second bosses for drawing the first and second bosses together.

16. The apparatus of claim 15 wherein the projection is removably received between the first and second free ends of the annular wall.

17. The apparatus of claim 16 wherein the projection has a securement end opposite to the free end, with the securement end including an aperture positioned between the first and second bosses, with the bolt extending through the aperture of the securement end of the projection, with the securement end including a mast for abutting with one of the first and second bosses to prevent pivoting of the projection about the bolt with the free end of the projection moving radially inward of the securement end.

18. The apparatus of claim 14 wherein the securing means further comprises, in combination: a C-shaped adapter having an internal surface for slideable receipt on the magnification adjustment ring and an external surface for slideably receiving the annular wall.

19. The apparatus of claim 18 wherein the drawing means comprises, in combination: first and second, parallel bosses on the annular wall on opposite sides of the transverse cut and extending outwardly from the annular wall; and a bolt extending between the first and second bosses for drawing the first and second bosses together.

20. For use with a variable power telescope sight having an eyepiece including an ocular end and a magnification adjustment ring axially spaced from the ocular end of the eyepiece, with the magnification adjustment ring being rotatable about an axis, an apparatus for rotating the magnification adjustment ring by a circumferential force axially spaced from the magnification adjustment ring and adjacent to the ocular end of the eyepiece comprising, in combination: a projection having a free end; and means for securing the projection to the magnification adjustment ring in a fixed, non-movable relation thereto, with the projection integrally extending from the securing means with the free end of the projection being adjacent to the ocular end of the eyepiece and pushable to rotate the magnification adjustment ring about the axis.

21. The apparatus of claim 20 wherein the magnification adjustment ring has a shape; and wherein the securing means comprises a pinch clamping band including an annular wall of a shape generally corresponding to the shape of the magnification adjustment ring, with the annular wall including a transverse cut defining first and second free ends, and including means for drawing the first and second free ends of the annular wall together to clamp the annular wall upon the magnification adjustment ring, with the projection integrally extending from the wall diametrically opposite the transverse cut.

22. For use with a variable power telescope sight having an eyepiece including an ocular end and a magnification adjustment ring axially spaced from the ocular end of the eyepiece, with the magnification adjustment ring being rotatable about an axis, an apparatus for rotating the magnification adjustment ring by a circumferential force axially spaced from the magnification adjustment ring and adjacent to the ocular end of the eyepiece comprising, in combination: a C-shaped adapter having an internal surface for slideable receipt on the magnification adjustment ring and having an external surface; a projection having a free end; and means for securing the projection to the magnification adjustment ring in a fixed, non-movable relation, with the free end being adjacent to the ocular end of the eyepiece, with the free end of the projection being pushable to rotate the magnification adjustment ring about the axis, with the securing means being received on the external surface of the adapter and the adapter being intermediate the magnification adjustment ring and the securing means.

23. The apparatus of claim 22 wherein the magnification adjustment ring has a shape; and wherein the securing means comprises a pinch clamping band including an annular wall of a shape generally corresponding to the shape of the magnification adjustment ring, with the annular wall slideably receiving the external surface of the adapter.

24. For use with a variable power telescope sight having an eyepiece including an ocular end and a magnification adjustment ring axially spaced from the ocular end of the eyepiece, with the magnification adjustment ring being rotatable about an axis, an apparatus for rotating the magnification adjustment ring by a circumferential force axially spaced from the magnification adjustment ring and adjacent to the ocular end of the eyepiece comprising, in combination: a first projection having a free end; a second projection having a free end; and means for securing the first and second projections to the magnification adjustment ring in fixed, non-movable relations, with the free ends of the first and second projections being adjacent to the ocular end of the eyepiece, with the free ends of the first and second projections each being pushable to rotate the magnification adjustment ring about the axis.

25. The apparatus of claim 24 wherein the magnification adjustment ring has a shape; and wherein the securing means comprises a pinch clamping band including an annular wall of a shape generally corresponding to the shape of the magnification adjustment ring, with the annular wall including a transverse cut defining first and second free ends, and including means for drawing the first and second free ends of the annular wall together to clamp the annular wall upon the magnification adjustment ring; and wherein the first projection integrally extends from the annular wall.

26. The apparatus of claim 25 wherein the first projection integrally extends from the annular wall diametrically opposite the transverse cut; and wherein the second projection is removably received between the first and second free ends of the annular wall.

* * * * *